United States Patent [19]

Zulfilar

[11] Patent Number: 4,504,892

[45] Date of Patent: Mar. 12, 1985

[54] ART LIGHTING SYSTEM WITH STEPWISE CREATION AND DISPLAY OF WORKPIECE

[76] Inventor: Farida Y. Zulfilar, Villa La Cretaz, Chernex 1822 (Vaud), Switzerland

[21] Appl. No.: 460,024

[22] Filed: Jan. 21, 1983

[51] Int. Cl.[3] ..... F21V 33/00

[52] U.S. Cl. ..... 362/234; 362/33; 362/295; 362/20; 362/806; 362/251; 362/252; 40/152.2; 354/132; 354/291; 354/349

[58] Field of Search ..... 362/11, 13, 33, 125, 362/127, 128, 145, 227, 251, 295, 20, 234, 806; 354/128, 132, 150, 290, 291, 348, 349, 350; 40/152.2, 904

[56] References Cited

U.S. PATENT DOCUMENTS

| | | | |
|---|---|---|---|
| 947,127 | 1/1910 | Roberts | 40/152.2 |
| 1,739,320 | 12/1929 | Lloyd | 40/152.2 |
| 2,393,316 | 1/1946 | Edgerton | 354/132 X |
| 2,408,764 | 10/1946 | Edgerton | 354/132 X |
| 2,637,131 | 5/1953 | Paulson | 40/152.2 |
| 3,967,107 | 6/1976 | Junginger et al. | 362/33 |
| 4,159,871 | 7/1979 | Arnone | 362/33 X |
| 4,167,783 | 9/1979 | Mitchell | 362/285 X |
| 4,196,460 | 4/1980 | Schreckendgust | 362/295 X |
| 4,392,187 | 7/1983 | Bornhorst | 362/293 X |

*Primary Examiner*—Peter A. Nelson

*Attorney, Agent, or Firm*—Kenyon & Kenyon

[57] ABSTRACT

Improved visual effects which are quite pleasing are obtained by illuminating paintings with a lighting system comprising at least two light sources directed on the art work from in front and above, and in front and to the side, respectively, with at least one of the light sources varied in intensity from a maximum to a minimum, the other light source maintaining at least a minimum amount of illumination when the one light source reaches it minimum.

16 Claims, 3 Drawing Figures

ART LIGHTING SYSTEM WITH STEPWISE CREATION AND DISPLAY OF WORKPIECE

BACKGROUND OF THE INVENTION

This invention relates to the lighting of paintings and other art objects in general, and more particularly to a lighting system which gives enhanced and varied visual effects to such art objects.

Typically, the lighting of paintings and other art objects is of a static nature. Although in the past, the control of lighting with respect to position and brightness has been possible and has been capable of being adjusted from time to time, once adjusted it remained static. Selection of lighting is typically made for each art object based on the particular object and what looks best. Once that effect is established, it is usually not changed.

It is the object of the present invention to provide an enhanced visual experience when viewing certain types of art through the use of a lighting system in which the intensity changes such as to give different visual effects as would happen outdoors.

SUMMARY OF THE INVENTION

The present invention provides a lighting system in which varied and enhanced visual effects are obtained through the use of at least two spotlights aimed at the painting or other art objects, at least one of which lights automatically changes in intensity over a period of time.

Through the present invention, it is possible to create the effects of, for example, in a landscape, changing times of day so that the picture will appear as representing times varying from sunrise through sunset. In the case of paintings of animals or humans, for example, it is possible to create changes in expression or the like with changing lighting.

In general, a light located off to the side is set to have a minimum intensity and pointed at some object or part of the picture which it is desired to maintain illuminated at all times. A second light from another side, preferably directed from above, is coupled to automatic equipment causing it to brighten and dim cyclically at a predetermined rate. When the light which is being brightened and dimmed reaches its minimum intensity close to zero, the remaining light at the side still maintains a minimum of illumination on the picture to maintain the desired effect.

Furthermore, particulary good effects are obtained with paintings which have been created while lighted with the system, the artist creating different effects at different light levels.

Although the disclosure herein is primarily in terms of paintings, the present invention is similarly applicable to sculptures, mobiles, tapestries, and other types of art.

DETAILED DESCRIPTION

Figure 1:
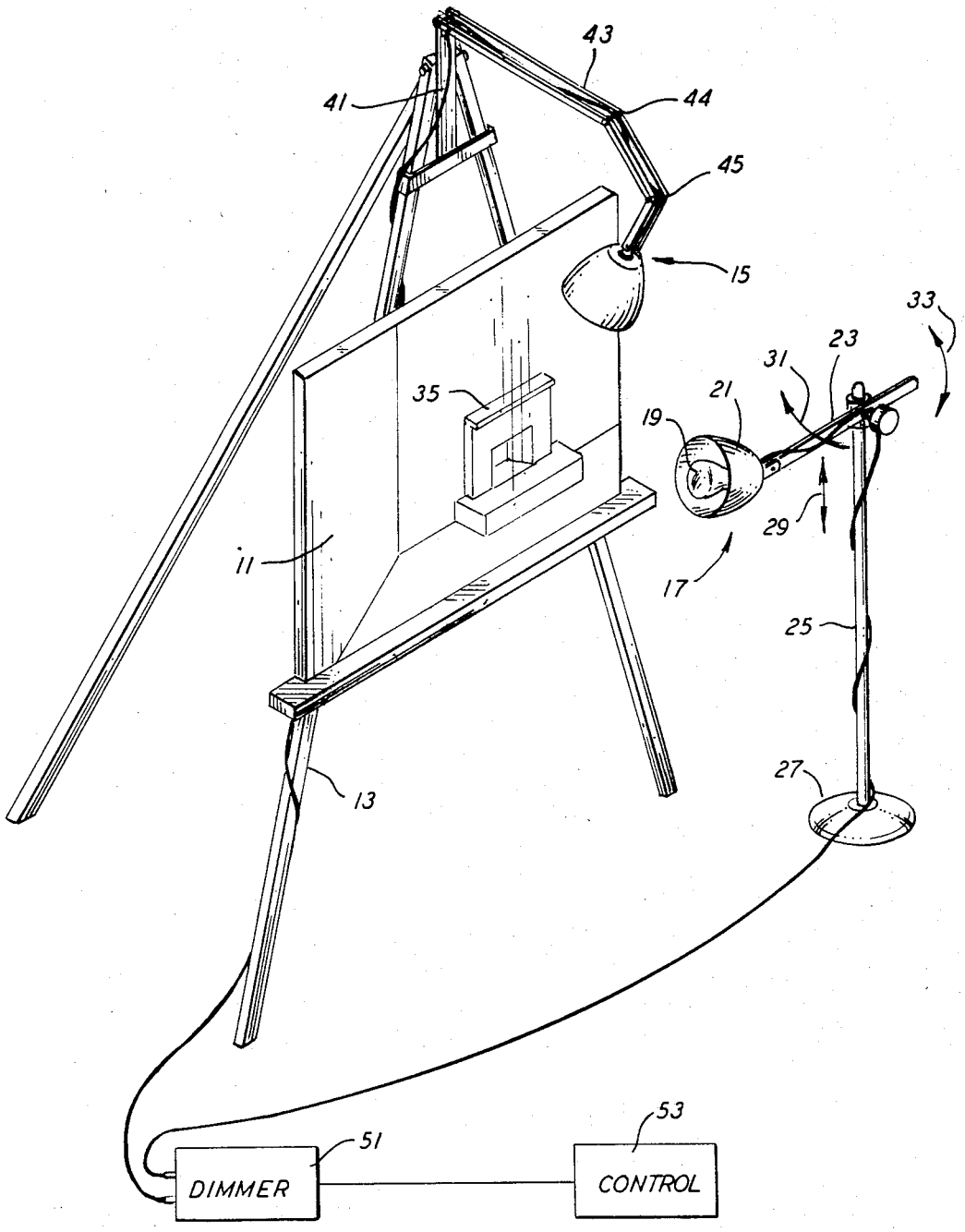
FIG. 1 is partially a perspective view and partially a block diagram illustrating the one embodiment of the system of the present invention.

FIG. 1 is a perspective view at the top showing a painting 11 resting on an easel 13 and having a first source of illumination 15 located above and in front of the painting and a second source of illumination 17 located in front and to the side of the painting. (In the context of the present invention, the terminology "to the side" includes any of the four sides of the painting. In most embodiments, it will be at the left or right side.) The source of illumination 17 includes a flood light 19 and reflector 21. It is mounted on an arm 23 supported on a vertical member 25 secured to a stand 27. In conventional fashion, a connection is made between the arm 23 and vertical member 25 which permits positioning the light source 17, up and down in the direction of arrow 29, rotationally as indicated by arrow 31 and rotationally as indicated by an arrow 33. Naturally, the stand 27 is movable. This permits adjusting the light to shine on any desired spot on the painting 11. For example, if the painting 11 was a painting of a room as is illustrated schematically with a fireplace in the room, the source 17 could be directed at the fireplace. In accordance with the present invention, the source 29 will stay on, at least, at a dim level, at all times. Thus, even with the light source 15 off completely, a dim glow effect from the fireplace 35 would be evident giving a pleasing effect. The light source 15 is secured by means of a bracket 41 having a flexible extending arm 43 thereon. The arm illustrated is shown has having joints 44 and 45. Any conventional mounting of this nature may be used in accordance with the present invention. Furthermore, the bracket 41 should be vertically adjustable on the easel in order that the light source 15 can be properly positioned in front of the painting 11 to give the right effect. Again, the source 15 will include a conventional reflector with a flood light inside. A light which has been found particularly useful is a 35 par flood and spotlight.

In the illustrated embodiment, the power to the two light sources 15 and 17 is supplied from a dimmer 51 which will, of course, be capable of driving at least two lamps. In this embodiment, the dimmer is driven or controlled by a control 53 which is a dual-cross fader and automatic double-dimmer. For example, Times Square model DCF-2 which has 1200 watts per channel may be used. This model incorporates the units 51 and 53.

Figure 2:
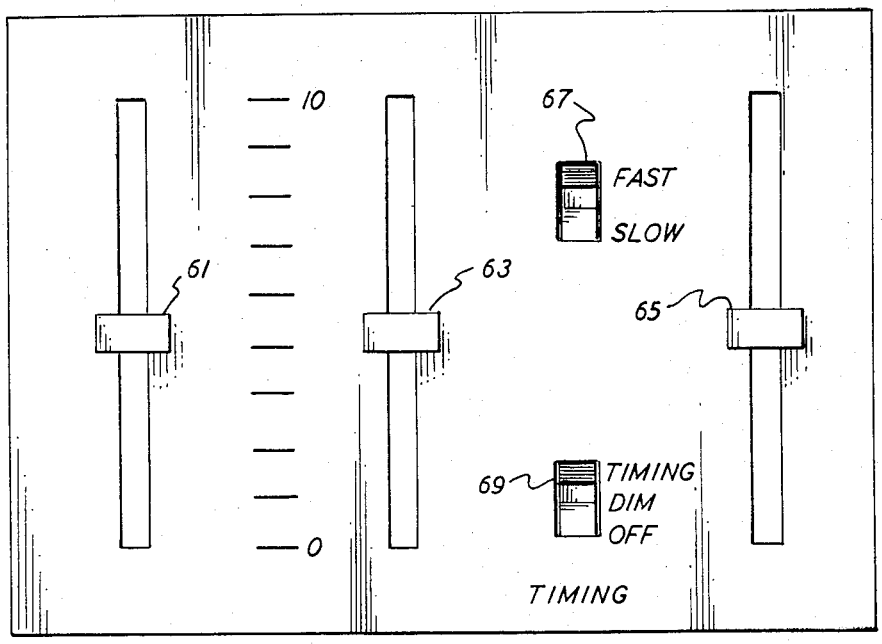
FIG. 2 is a plan view of a dual-cross fader and automatic double-dimmer control used in the embodiment of FIG. 1.

FIG. 2 shows the plan view of the dual-cross fader and automatic double-dimmer control. Included are three sliding potentiometer controls with handles 61, 63 and 65, respectively. The controls 61 and 63 set the maximum level for channels 1 and 2. The control 65 sets the speed of cycling or automatic dimming. Two speed ranges are available, fast and slow. The range for the fast speed is two seconds to one minute and the slow ranges from one to twenty minutes. Both ranges are useful with the present invention. Speed selection is accomplished with a switch 67. Finally, there is a switch 69 which allows the selection of "timing", "dim" or "off". For use with the present invention, it is placed in the "timing" position. Since this is a dual-cross fader, as the light, for example, channel 1 controlled by the potentiometer 61 is brought up, the lights of channel 2 controlled by potentiometer control 63 will be brought down. Similarly, as the level of the channel 2 is brought up, channel 1 will be brought down. Typically, assuming channel 2 controls the source 17, it will be set at a low level, and channel 1, controlling the light source 15 at a higher level. When the light source 15 reaches its minimum level where it is almost off, the light source of channel 2, i.e., the light source 17 will be at its maximum level. However, this maximum is set to be quite dim to give only the remaining glow which is desired.

Figure 3:
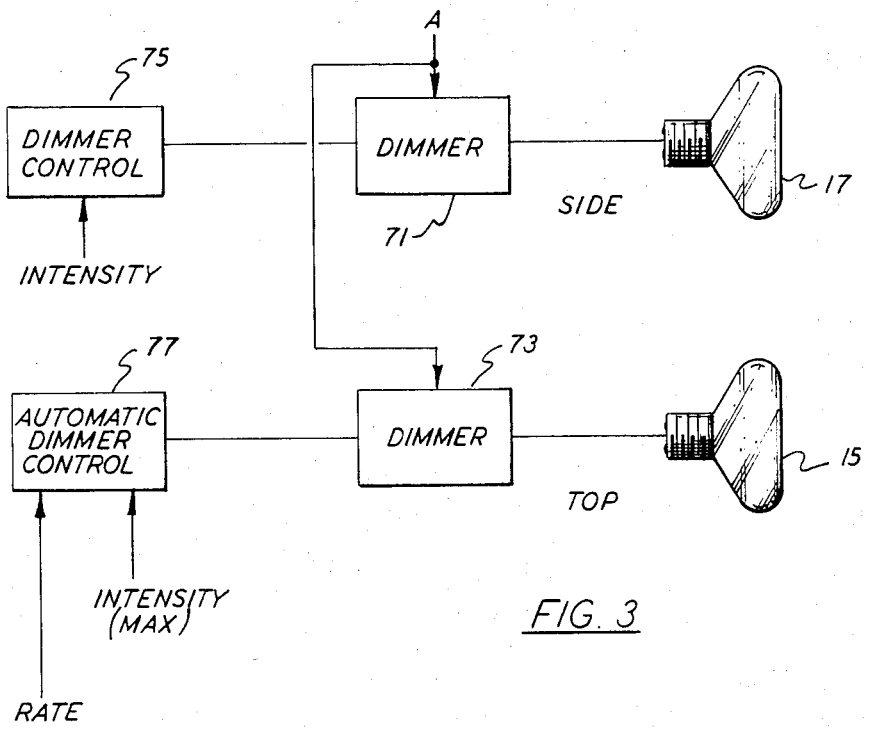
FIG. 3 is a block diagram of an alternate embodiment of the present invention.

FIG. 3 shows an alternate embodiment for controlling the light sources 15 and 17. In this case, dimmers 71 and 73 are provided. Dimmers 71, which drives light source 17, is controlled by a simple dimmer control 75, i.e., this can simply be a potentiometer controlling a triac in the dimmer control 17. The only input is the intensity input from the potentiometer. However, the light source 15 must be automatically cycled up and down and thus requires an automatic dimmer control 75 which has a rate input and a maximum intensity input. Again, the dimmer 73 can be a conventional triac or SCR device. In this case, the control signal will be in the nature of a triangular wave or a signal which is ramped up and down at a rate determined by the rate input. This equipment is generally of the type mentioned above available from Times Square.

A further aspect of the present invention which should be noted is that as the light becomes brighter and dimmer, its color temperature changes. As a result, different colors are brought out to different extents at different intensities. This contributes to the effect of seemingly looking at different scenes with different intensities. In accordance with a further feature of the present invention, an artist who wishes to make use of the present invention, can create his paintings using this lighting, painting, in effect, different scenes at different light levels. The artist will be able to see with, any given lighting level, how the painting will appear when it is finished and can use the color and texture necessary to get the desired effect for a given light setting, which effect will change as the light setting is changed.

As noted above, the present invention is not limited to paintings but may also be used with other types of art objects. Furthermore, although the embodiments just mentioned are thought to be the most effective ones, it is possible to have both light sources 17 and 15 operate in unison in some cases.

I claim:

1. A system for creating and displaying art work comprising:

(a) a first light source;

(b) means to support said first light source at a position above and in front of the art work;

(c) a second light source;

(d) means to support said second light source to the side and in front of said art work;

(e) means to fix the intensity of said second light source;

(f) means to stepwise vary the intensity of said first light source while creating the art work, in said stepwise manner, furthermore means to display said art work with said displaying means comprising:

(g) means to adjust the intensity of one of said light sources;

(h) means to set a maximum intensity for said other light source and to automatically vary said other light source between said maximum and a minimum, which at least approaches zero intensity, at a predetermined rate; and wherein:

(i) said art work is responsive to adjustments in the intensity of said light sources such that varying the level of light incident of said art work give the appearance of a changing scene.

2. Apparatus according to claim 1, and further including means to set the rate of variation of said other light source.

3. Apparatus according to claim 1 or 2, and further including means to vary the intensity of said one light source at said predetermined rate.

4. Apparatus according to claim 3, wherein said means to vary comprise a dual-cross fader and automatic double-dimmer whereby when one of said light sources is brought to its maximum intensity, the other light source is brought to its mimimum intensity and vise versa.

5. Apparatus according to claim 3, wherein said two light sources are changed between maximum and minimum together.

6. Apparatus according to claim 1, wherein said first light source is said other light source.

7. Apparatus according to claim 1, wherein said second light is disposed on the right or left side of said art work.

8. The method of lighting art comprising:

(a) directing light from one light source onto said art from in front and above;

(b) directing light from another light source onto said art from the side and in front of said art work;

(c) setting the intensity of at least one said sources to a predetermined minimum lighting level; and (d) varying the intensity of the other of said sources at a predetermined rate between a predetermined maximum and predetermined minimum level which approaches zero; and wherein:

(e) said art comprises a painting and further including creating said painting by steps comprising adjusting said first light source so that it remains fixed at various ones of the levels between maximum and minimum and, at each of said levels creating said painting to give different desired effects, whereby as said light is varied on the finished painting, different effects will be evident.

9. The method according to claim 8, comprising varying both of said light sources between a predetermined minimum and predetermined maximum.

10. The method according to claim 8, comprising carrying out said variation such that when one light source is at a maximum the other is at a minimum and vise versa.

11. The method according to claim 8, comprising setting the maximum intensity of said second light source to be at a value which will only dimly light said art work and varying said first light source between a minimum which approaches no light and a maximum which brightly lights said art work.

12. The method according to claim 11, wherein said art work comprises a picture having therein a portion which would be thought of as a source of light and further including directing said second light source at said source point on said painting.

13. The system of claim 1, wherein said art work is a painting.

14. Apparatus according to claim 1, wherein said means supporting said first light source permits adjustment of said light source vertically with respect to said art work, its distance from said art work, and its angle with respect to said art work.

15. Apparatus according to claim 1 or 7, wherein said means supporting said second light source permits locating said light source spacially and angularly so as to direct it on any desired spot of said art work.

16. Apparatus according to claim 1, in combination with a painting which has been painted so as to produce different effects at different light levels.

* * * * *